United States Patent [19]

Kobler

[11] Patent Number: 4,516,759

[45] Date of Patent: May 14, 1985

[54] ROTARY PRINTING MACHINE OUTPUT SPEED MATCHING SYSTEM FOR SHEET FOLDER

[75] Inventor: Ingo Kobler, Anhausen, Fed. Rep. of Germany

[73] Assignee: M.A.N.-ROLAND Druckmaschinen Aktiengesellschaft, Offenbach am Main, Fed. Rep. of Germany

[21] Appl. No.: 616,176

[22] Filed: Jun. 1, 1984

[30] Foreign Application Priority Data

Jun. 16, 1983 [DE] Fed. Rep. of Germany ..... 3321811

[51] Int. Cl.[3] ..... B41F 13/64

[52] U.S. Cl. ..... 270/12; 101/232; 271/202; 271/182

[58] Field of Search ..... 270/4, 12, 20.1, 15, 270/17–18; 101/219, 232; 493/444; 271/69, 198, 202, 182

[56] References Cited

U.S. PATENT DOCUMENTS

| | | | |
|---|---|---|---|
| 405,016 | 6/1889 | Crowell | 270/19 |
| 2,261,972 | 11/1941 | Matthews | 271/202 |
| 3,650,527 | 3/1972 | Helm | 271/202 |
| 3,911,800 | 10/1975 | Feldkamper | 271/182 |
| 3,994,221 | 11/1976 | Littleton | 271/202 |
| 4,111,411 | 9/1978 | Graves et al. | 271/202 |
| 4,133,523 | 1/1979 | Berthelot | 271/182 |
| 4,214,743 | 7/1980 | Meter | 270/12 X |
| 4,239,201 | 12/1980 | Richter | 493/444 |
| 4,461,467 | 7/1984 | Herb | 271/202 |

*Primary Examiner*—E. H. Eickholt

*Attorney, Agent, or Firm*—Frishauf, Holtz, Goodman & Woodward

[57] ABSTRACT

To match the speed of incoming sheets, typically folded sheets, form a first high-speed transport system (3, 4) to a receiving speed of a second, lower speed transport system (5, 6), a decelerating path is formed by a third transport system (1, 2) which includes moving belts which are looped about looping rollers (17, 18) in S-configuration to further define a third path between opposed rollers (19, 20), the looping rollers being reciprocatably connected to a slide unit by an eccenter-and-crank arrangement (22, 23) so that the belts (14, 14') of the third unit will have undulating variable speed between maximum and minimum. The rotation of the eccenter-and-crank arrangement (22, 23) is synchronized with the transport of sheets such that, when the belts are at their maximum speed, they are about to grip the leading edge of a sheet being fed thereto, and then decelerate to their minimum speed when the sheets are about to leave the third transport system. The receiving belts of the second, slower speed system may also be stationary, or be replaced by a slide table to receive the sheets in imbricated (FIG. 5) position.

15 Claims, 5 Drawing Figures

1
14
15
16
17
18
19
20
21
22
23
24
25
26
27
28
29
30
31
32
33
34
35
36
37
38
39
41
46
H
III
IV

ROTARY PRINTING MACHINE OUTPUT SPEED MATCHING SYSTEM FOR SHEET FOLDER

The present invention relates to a system suitable for use with rotary printing machines to match the speed of output from the rotary printing machine to other equipment operating at a slower speed, and more particularly to folding apparatus for use in combination with rotary printing machines to fold one or more sheets which may be superimposed as received from the printing machine.

BACKGROUND

Many types of printing machines utilize folding apparatus in which the sheets or sheet units, for example superimposed layers of sheets such as superimposed newspaper sheets, are transported between belt transport systems having upper and lower belts. The output transport belt lines receiving the printed material from the printing machine operate at a first high speed; subsequent receiving belt transport systems operate at a lower speed. It is, therefore, necessary to provide an intermediate system to match the speed of the sheets received from the printing machine to the sheets which can be handled by the subsequent lower speed belt system.

German Published Patent Application DE-AS No. 27 50 592 describes apparatus in which sheets delivered from a folding cylinder, after a first fold, are supplied to a first belt transport system. They are then oriented and delayed with respect to a stop element which operates at a speed slower than the supply speed of the first belt line or system. The delayed and oriented elements, for example the folded sheets, are then transmitted to a second belt line which operates at a lower speed, which is associated with a folding knife to form a "third fold" which, actually, is a second longitudinal fold.

Arrangements of this type have the disadvantage that the sheets meet at high speed the stop element which operates at a lower speed; when the difference in speed exceeds a certain level, the folded high-speed sheets have a tendency to bounce backwardly or to misalign; if this is the case, the "third fold", actually the second longitudinal fold, will no longer be carried out with sufficient accuracy.

THE INVENTION

It is an object to provide a speed matching system in form of a delay line which permits matching the speed of sheets being delivered from a first, high-speed transport system to that of a second, or lower speed transport system, to carry out a folding operation at the second, or lower speed.

Briefly, a third belt system is interposed between the first or high-speed belt system and the second or lower speed belt system, the third belt system being operable at a variable speed. The speed varies in synchronism with the supply of sheets from the first system; when the leading edge of a sheet being delivered by the first, high-speed system reaches the third belt system, the speed of the third belt system is high, and, preferably, close to or the same as the speed of the high-speed system; the sheet or stack of sheets which have been gripped by the third belt system are then transported by the third belt system at a decelerating rate, the final speed of the third belt system being that or close to the speed of the second slow-speed belt system, at which time the sheet, or sheets, is delivered to the second slower speed system. The third belt system is then re-accelerated to permit pick-up of a subsequent sheet from the first or high-speed system.

The length of the third belt system and the transport speeds of the first and second belt systems are relatively matched to permit deceleration and acceleration of the third belt system between the first and second speeds, while transporting sequential sheets from the first to the second transport belting system, and re-accelerating to pick up a subsequent sheet.

DRAWINGS

DETAILED DESCRIPTION

Figure 1:
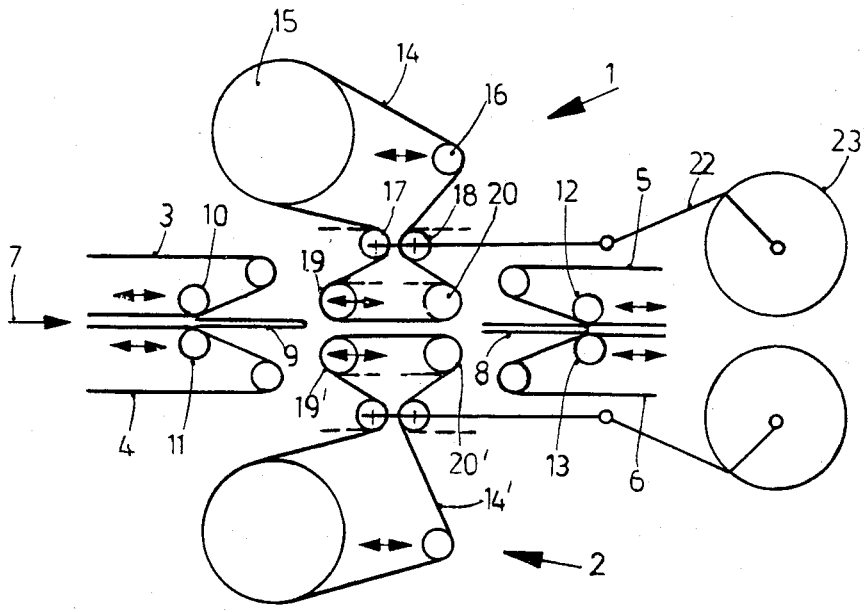
FIG. 1 is a schematic side view of the speed matching system.

An upper and a lower delay line 1, 2, for sheets or a stack of sheets—hereinafter merely referred to as "sheet, or sheets", for simplicity—are shown in FIG. 1. The two belt systems above and below the sheets are identical, and preferably constructed in mirror-image arrangement, located above and below the transport path of the sheets. For left-right or simplicity, only the upper system 1 will be described; if necessary, similar elements for the lower system have been given the same reference numeral and furnished with prime notation. They are not separately described since the prime-notation elements are similar to those without the prime notation. This convention will be adopted throughout the specification for all elements which are provided in duplicate.

The left belt transport system of FIG. 1 has an upper system 3 and a lower system 4. Sheets, for example derived from a collection cylinder and furnished at a predetermined distance from each other are supplied at a first speed to the matching system 1, 2. The sheets, from the matching system, and behind the matching system in the direction of movement of the sheets, are then supplied, at a lower speed, to a low-speed second sheet transport belt arrangement 5 above the sheets and a lower belt transport arrangement 6 therebelow. Arrow 7 illustrates the direction of movement of the sheets, in which sheets 8, 9, already folded in the folding apparatus, are transported between the belts 3, 4. They leave the belts which are guided by suitable rollers through a wedge-shaped opening formed between the belts 3, 4. The length of the opening between the belts 3, 4 is variable by changing the position of the compression rollers 10, 11, as schematically shown by the arrows next to the rollers 10, 11. The second or slower transport belts 5, 6 also have a wedge-shaped opening to receive the slow-speed sheets; the length of the wedge-shaped opening is variable by changing the position of the incoming or inlet engaging rollers 12, 13 as schematically indicated by the arrows next to the rollers 12, 13. The rollers 10, 11 and 12, 13 can be adjusted to accomodate respective changes in speed, length of the sheets, and the like.

The upper speed matching line 1 includes a belt system 14 which is guided about a movable deflection roller 16 and about a drive roller 15. The roller 16, simultaneously, functions as a tension roller. The belts 14 are then guided in S-shaped paths about rollers 17, 18, 19, 20, positioned below rollers 15, 16. One of the rollers 19, 20, preferably, should be individually adjustably positioned to move back and forth, as shown by the double arrow. The roller 19, forming a belt guide roller, is journalled for rotation about a belt 36. The position of the bolt 36 permits matching of the length of the speed matching line or belt portion extending between the rollers 19, 20 to the respective length of the sheets 8, 9.

It is an important feature of the invention that the portions of the belt 14 which are located between the rollers 17, 19, as well as 18, 20 and 15–17, as well as 16–18, can be shifted parallel with respect to each other and parallel to the transport path of the sheets, as shown in broken lines in FIG. 1. The precise path of the various portions of the belts is shown FIG. 1 only schematically, for clarity of representation. The actual path may deviate somewhat.

In accordance with the invention, the rollers 18, 19 are commonly moved in a direction parallel to the transport direction of the sheets 8, 9, which sheets are adapted to be folded. Shift of the transport system, physically, that is, shifting the belts, superimposes a speed with which the belts are running on the belt speeds when moved in one direction, and detracts from the running speed of the belts when the rollers 19, 20 are shifted in the opposite direction. Shift is carried out, as shown schematically in FIG. 1, by means of an eccenter drive 22, 23 which is so arranged that the belt 14—and, of course, the lower belt 14' of the system 2—has its maximum speed which corresponds to the speed of the belts 3, 4 when the front edge of a folded sheet reaches the zone between the belts 14, 14'. This permits gentle transfer of the sheets 8, 9 between the belts 14, 14', without shock or jarring. As soon as the trailing edge of the sheets 8, 9 has left the belts 3, 4, the speed of lines 14, 14' with respect to a fixed datum or reference, for example the frame of the machine on which also the belts 3, 4; 5, 6 are journalled, is reduced until the speed of the belts 14, 14' with respect to the reference matches that of the speeds 5, 6. This deceleration or drop in speed must be terminated before the front edge of the sheets 8, 9 reaches the belts 5, 6 and is gripped thereby. The transfer of the sheets to the belts 5, 6 then also will be gentle, and without shock or speed differential. Thus, the sheets are transferred to the slower belt systems 5, 6 from the higher speed systems 3, 4 without shock, damage, or possibility of bouncing or misalignment. The shiftable rollers 10, 11, 12, 13 and 19, 19' insure that the speed relationships, with respect to the length of the sheets, is maintained. It is important that the distance between sequential sheets 8, 9 is so selected that a second following sheet, such as a sheet 9, is supplied to the system 1, 2 only after the preceding sheet 8 has left the system 1, 2. This condition is readily met in a collection arrangement, collecting folded sheets from a printing machine; if the printing machine should operate at a still higher speed, switches may be interposed which selectively, for example alternately, split a stream of sheets between a plurality of transport paths.

Figure 2:
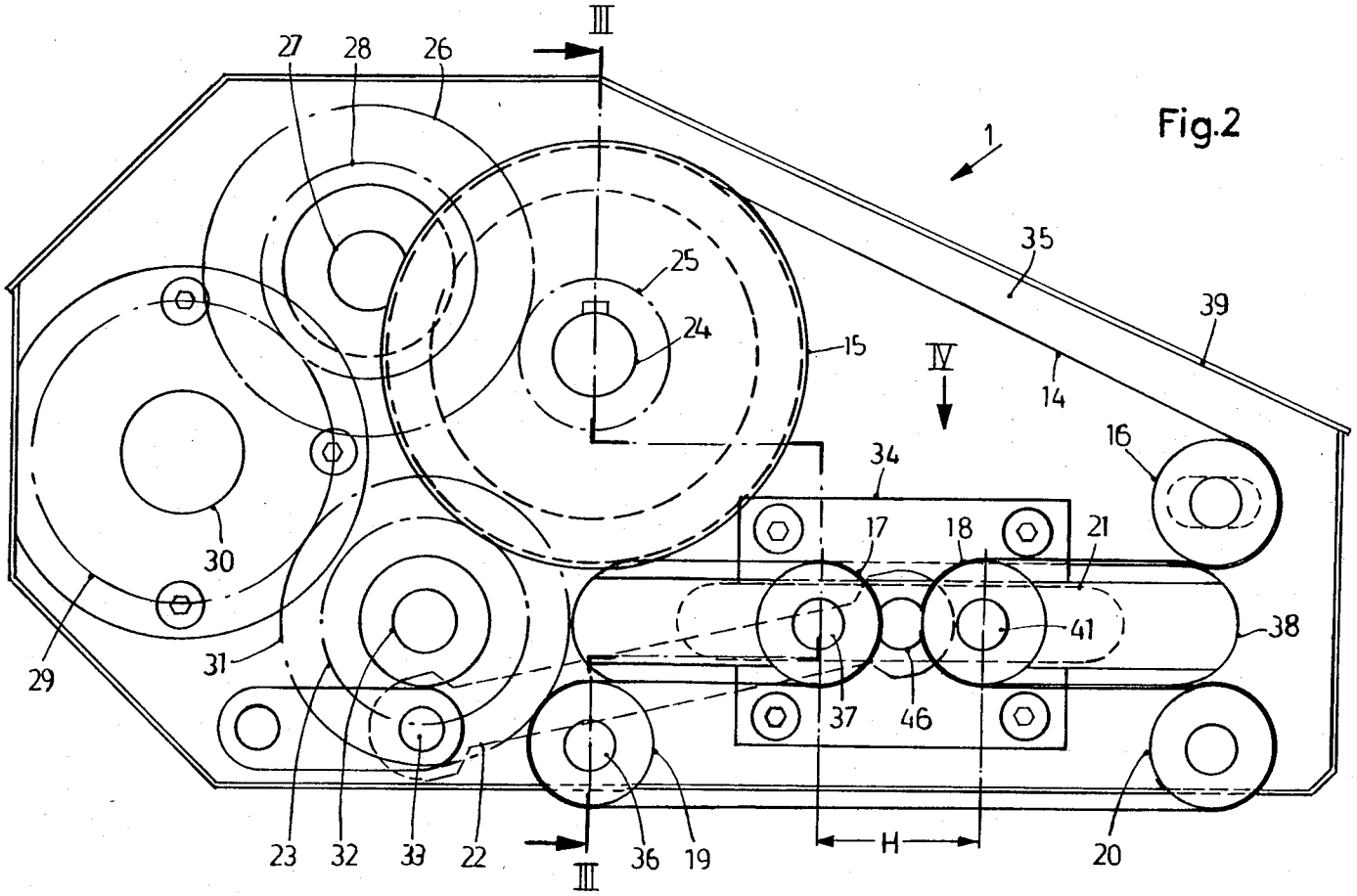
FIG. 2 is a side view of the upper elements of the speed matching system.
Figure 3:
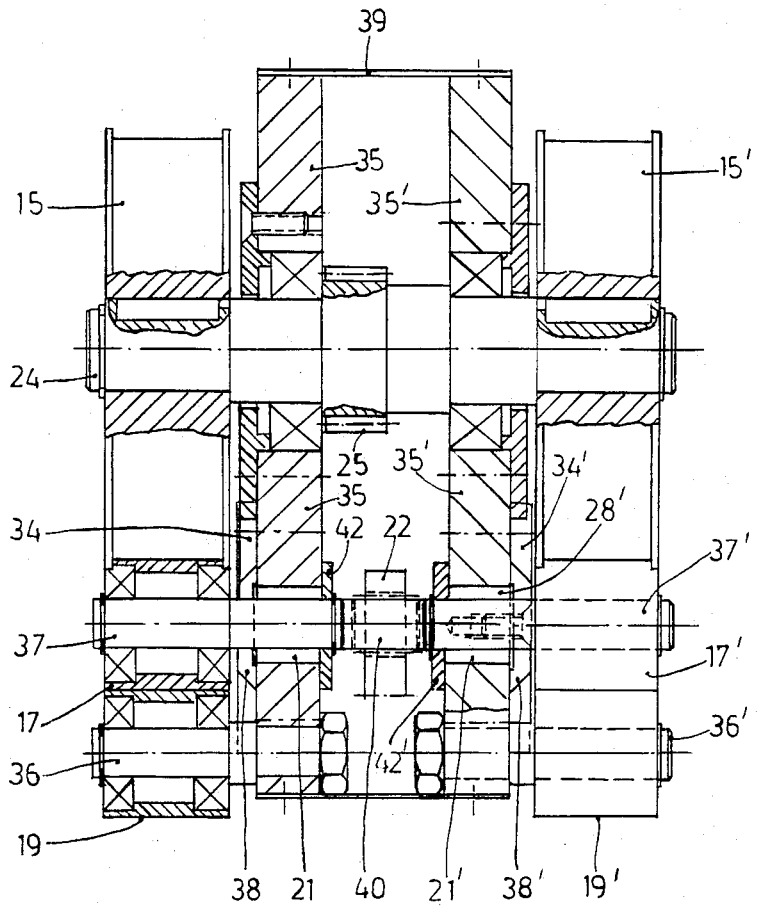
FIG. 3 is a cross section along line III—III, which is a broken section, of FIG. 2.
Figure 4:
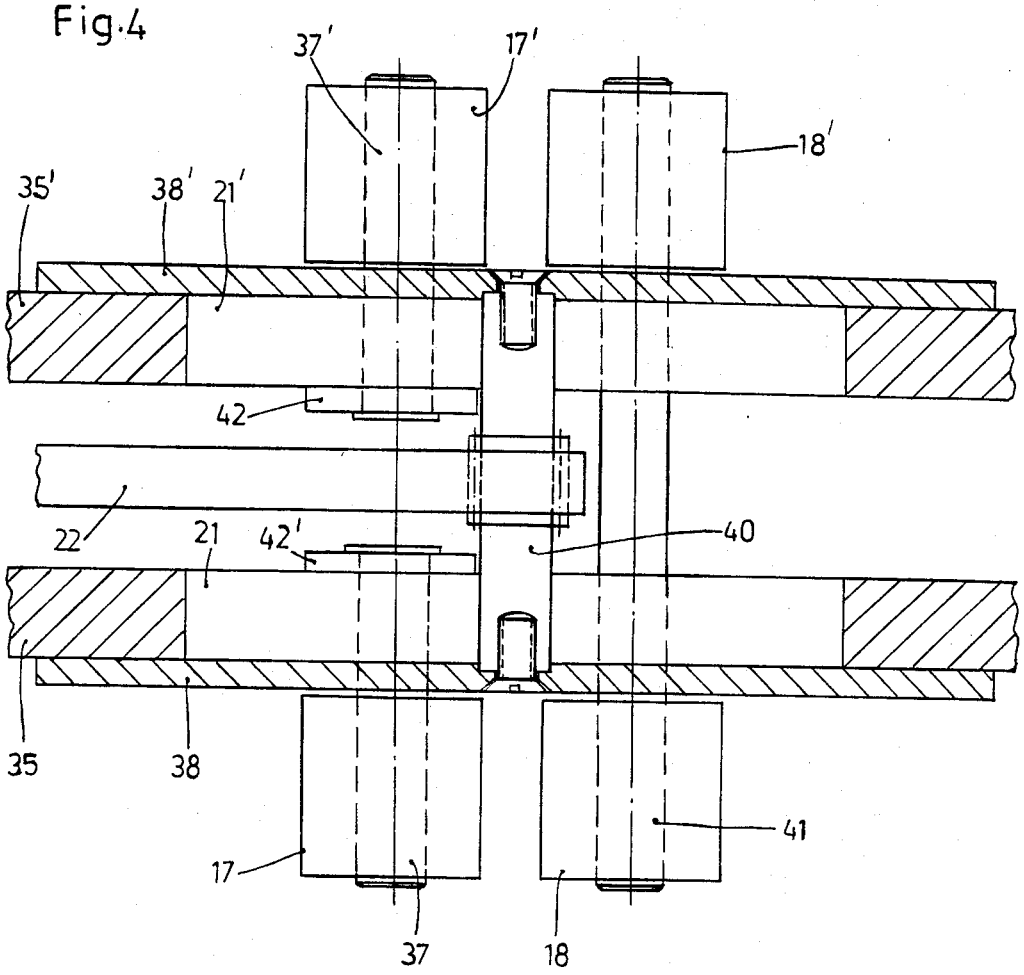
FIG. 4 is a top of the apparatus of FIG. 2.

The upper system 1 in FIGS. 2–4 in greater detail, referring to FIG. 2: The drive roller 15 is located on a shaft 24 which operates at three times machine speed. A drive gear 25 is located on the shaft 24, which is driven by a gear 26 located on a shaft 27 on which a further gear 28 is positioned. Gear 28 is driven by gear 29 on a shaft 30 which operates at machine speed.

The gear 29 on shaft 30 further drives a gear 31 located on a shaft 32, and operating at machine speed. The eccenter disk 23 is located on the shaft 32. The lever 22 is eccentrically secured to the disk 23, and selectively removable therefrom to permit selective disabling of the center drive. Pin 33, thus, represents a removable pivot connection.

The rolles 17, 18 about which the belt 14 is looped are thus moved back and forth in the rhythm of supply of the sheets. With respect to a fixed reference, then, the speed of the belt 10 will increase, and, upon movement in opposite direction, the speed of the belt will decrease. The variation will be about the average speed of the drive roller 15. The acceleration and deceleration, that is, the speed increase and reduction, with reference to a mean or average speed, is effective between the rollers 19 and 20. The speed of the matching line is first matched to that of the faster operating system 3, 4 and, when the sheet is to be delivered to the second or slower belt transport, is matched to the slower transport 5, 6, so that the sheets between the belts 14, 14' will be decelerated and delayed in transmission to insure gentle handling of the sheets between the higher and lower speed belt transport systems 3, 4 and 5, 6, respectively.

Operation: The acceleration and deceleration effect of the portion of the belt 14 between the rollers 19, 20 occurs this way: Upon shift of the deflection rollers 17, 18, an additional speed is forced on the belt 14 by, in effect, adding an additional length of belt; upon a movement of the rollers 17, 18 in opposite direction, some belt length is taken away from the path about the rollers 19, 20, thus decreasing the apparent speed.

The link 22, preferably, is connected between the two deflection rollers 17, 18—see FIG. 3—which provides for particularly desirable guiding relationships. As clearly seen in FIG. 2, when combined with FIGS. 3 and 4, the two guide elements 34, 34' are secured at the outside of two side walls 35, 35'. The side walls 35, 35' form a frame and support structure for the bearings and for all elements used in the system 1.

FIGS. 3 and 4 illustrate the use of two bolts 37, 37', each one journalled or secured in a side wall 35, 35', on which the deflection rollers 17, 17' are positioned. Suitable bearings are interposed between the bolts and the rollers; the bearings have been omitted for clarity, since they may be of any well-known suitable construction, for example ball bearings. In the embodiment shown, two belts 14, 14' are used adjacent each other. More than two belts, such as three or four, could be located next to each other, if the width of the sheets requires or makes additional support desirable.

Interruption of the positioning of the belts between the side walls 35, 35' is desirable in order to permit placement of the link 22 between the walls 35, 35', so that the rollers 17, 18 can be symmetrically engaged. Through-bolts might interfere with movement of the link 22.

Adjustable slide tracks 38, 38' are located between the guides 34, 34' of each of the side walls 35, 35'. The rollers 17, 18 are movable along the guide tracks which support the bolts 37, 37', 41 as well as a bolt 40. Upon to-and-fro movement of the tracks 38, 38' by the link 22, the deflection rollers 17, 18 are carried along to move therewith. In contrast to the bolts 37, 37' which carry the deflection rollers, rollers 18, 18' can be placed on one through-bolt 41 since the position of the through-bolt 41 does not interfere with movement of the link 22—see FIG. 4. The terminal end of the link 22 can be secured in the center of a cross bolt 40 by a suitable bearing. The cross bolt 40 is located on the slide elements 38, 38'. A cover 39 is preferably provided, for example made of sheet metal, in order to cover the speed matching arrangement and prevent dirt and contamination from interfering with proper operation.

The bolts 37, 37' are guided only within a very small range of the sliders 38, 38'; in accordance with a preferred feature, support plates 42, 42' are located at the inside of the side walls 35, 35'.

The rotary movement of the eccenter wheel or disk 23 is converted into longitudinal movement by the rod or link 22, moving the guide tracks 38, 38' to-and-fro to generate the desired delay or deceleration and acceleration, respectively, of that portion of the belt 14 which is beneath the deflection rollers 17, 18, and which move with the movement of the slide tracks 38, 38' since the rollers 17, 18 are journalled in the slide tracks 38, 38'. The side walls 35, 35' are formed with elongated slits 21, 21' within which the track elements 38, 38' operate, the slits being elongated and of suitable length to permit back-and-forth movement over a stroke H (FIG. 2).

Figure 5:
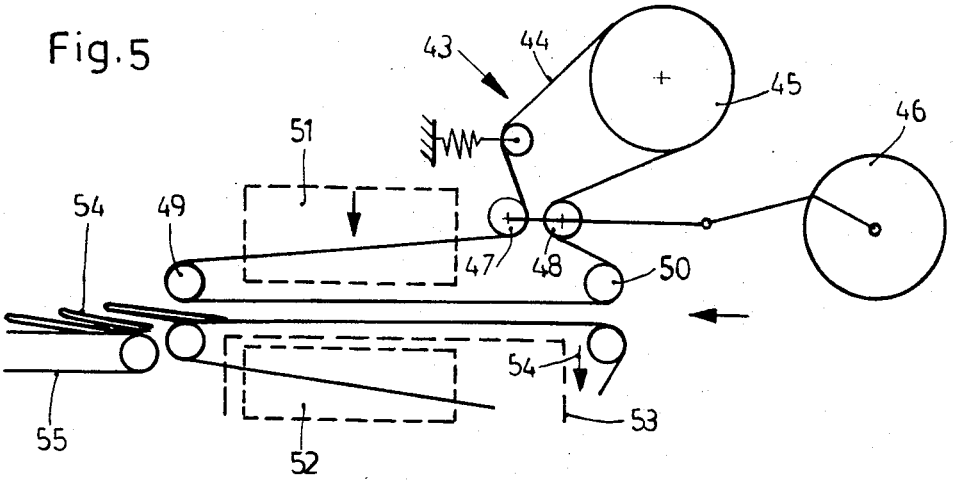
FIG. 5 is another embodiment of a speed matching system, in a representation similar to FIG. 1.

FIG. 5 illustrates another embodiment of the speed matching arrangement; only the upper portion 43 is shown, the lower portion being mirror-image symmetrical with respect thereto. The upper portion of the speed matching arrangement has a belt 44 driven by a drive roller 45. The belt is looped in S-shape about rollers 47, 48, 49, 50. In contrast to the embodiment of FIG. 1, rollers 49, 50 are spread much farther apart; a folding knife is movable downwardly against a folding roller 52. Folding knives and folding rollers are well known in the sheet folding art and, therefore, are shown only schematically by the broken-line boxes 51. The downward movement of the folding knife is schematically illustrated by the arrow in box 51.

In accordance with a feature of the invention, the folding knife of unit 51 is lowered at the time when the belt 44 has minimum speed. Upon lowering of the folding knife of unit 51, the sheet between the deflection rollers 49, 50 is supplied to the lower folding roller 52 in order to generate a second longitudinal fold. The folding roller pair 42 then may transfer the folded sheet directly to a distributing wheel, as well known in the sheet distribution art. The transfer is, preferably, direct.

In accordance with a further feature of the invention, the folding knife unit 51 may be disconnected, or disabled from operation. Upon lowering of the table 53, beneath which the folding cylinder 52 may be located, the folded sheets 54 can be supplied in imbricated form for further supply to a transport belt system 55, for example for subsequent handling by a stream feeder. The transport belt system 55 is then, preferably, positioned lower than the exit opening between the roller pair 49, 49' in order to properly place the folded sheets in imbricated position, as well known in the folded-sheet, for example newspaper feeding field. Belt system 55 may have zero speed, or be replaced by a table.

It is, of course, possible to disable the delay, if the receiving belt system of belts 5, 6 (FIG. 1) or belt 55 (FIG. 5) operate at high speeds, for example to permit operation at double production. For stream-feeding, a short belt arrangement is particularly suitable.

Various changes and modifications may be made within the scope of the inventive concept.

A suitable arrangement for a folding knife and folding cylinder, as shown schematically in FIG. 5 as elements 51, 52 is: U.S. Pat. No. 4,239,201.

I claim:

1. In and for combination with a paper folding apparatus receiving staggered, sequential sheets (8, 9) from a rotary printing machine having a high-speed transport system (3, 4, 10, 11) operating at a first and high speed;

a low-speed transport system (5, 6, 12, 13) operating at a second speed lower than said high speed;

and comprising, in accordance with the invention, a speed matching belt system to transport the sheets between the first and second systems and decelerate the sheets from the first, high speed to the second, lower speed, including a third system (1, 2, 14, 14') having belts operating at a variable speed, said third belt system being operable at a first high speed when the leading edge of the sheet (8) reaches the third belt system, and then decelerating to the second and slower speed;

said third belt system then again reaccelerating to reach the first high speed when the leading edge of a subsequent sheet (9) reaches the third belt system;

the length of the third belt system and the transport speed of the first belt system being matched to permit respective deceleration and acceleration of the third belt system between the first and second speeds while transporting sequential sheets from the first to the second transport system.

2. System according to claim 1, wherein the third belt system comprises variable speed transport belts (14, 14');

deflection rollers (19, 20, 19', 20'; 49, 50) positioned to define a third transport path located between the first and second belt systems, two each deflection rollers being spaced from each other to define the length of the third transport path within which the sheets are decelerated from the first, high speed to the second, lower speed;

paired looping rollers (17, 18; 47, 48) located on shafts (37, 41) movable in a direction transverse to the axes;

a drive roller (15, 45) driving said variable speed transport belt, the variable speed transport belts forming closed loops looped about the drive roller, and then in S-shape about the looping rollers and the deflection rollers;

and means (22, 23) for imparting reciprocating movement to the shafts (37, 41) of the looping rollers to thereby vary the length of the portion of the transport belts between the driver roller and the deflection rollers upon reciprocating movement of the reciprocating means and thereby change the speed of the portion of the transport belts between the deflection rollers in the third transport path.

3. System according to claim 2, wherein the first transport system includes a first guide roller (10) facing the third transport path; the second transport system includes a second guide roller (12) facing the transport path;

first and second belts looped about the guide rollers;

and at least one of the deflection rollers (19, 20) and the first and second guide rollers (10, 12) is shiftable in a direction transverse to the axis of rotation of the respective rollers and essentially parallel to the respective transport paths of the sheets in the respective transport systems.

4. System according to claim 2, wherein the reciprocating movement imparting means comprises an eccenter-and-crank system (22, 23).

5. System according to claim 4, wherein at least the third belt system comprises two parallel, aligned operating belts;

and the respective deflection rollers and looping rollers are double-roller element pairs, one, each, for one of the respective operating belts (14, 44).

6. System according to claim 5, further comprising an apparatus frame (35, 35');

a slide unit (38, 38') located in the frame and positioned for reciprocating sliding movement therein;

and wherein the respective roller elements are secured to said slide unit, and journalled therein, the eccenter-and-crank system (22, 23) being coupled to the slide unit and transferring rotary motion into reciprocating motion, a crank element (22) of said eccenter-and-crank system being secured to the slide unit and between the roller elements of one of the roller element pairs.

7. System according to claim 6, further including two short shafts (37, 37') locating the roller elements (17, 17') of a first pair on the slide unit (38, 38'), with the crank (22) of the eccenter-and-crank system positioned therebetween;

a long connecting bolt (41) locating the other pair of roller elements (18, 18') on the slide unit;

and support plates (42, 42') supporting the short shafts (37, 37') against the frame (35, 35').

8. System according to claim 2, wherein the means (22, 23) for imparting reciprocating movement can be disconnected from operative connection with the looping rollers.

9. System according to claim 1, further including a folding knife unit (51) located in alignment with said third belt system and synchronized in operation with the respective acceleration and deceleration of the third belt system to effect folding when the third belt system is at minimum speed, the folding knife being operable in a direction transverse to the operation of the third belt system.

10. System according to claim 2, wherein the second belt system is positionable out-of-alignment and below the third transport path to receive folded sheets in imbricated arrangement.

11. System according to claim 4, wherein a crank element of the eccenter-and-crank system is selectively disconnectable from operative connection with the looping rollers.

12. System according to claim 4, wherein the first transport belt system includes a first guide roller (10) facing the third transport path; the second transport system includes a second guide roller (12) facing the transport path;

and at least one of the deflection rollers (19, 20) and the first and second guide rollers (10, 12) is shiftable in a direction transverse to the axis of rotation of the respective rollers and essentially parallel to the respective transport paths of the sheets in the respective transport system.

13. System according to claim 9, wherein the first transport system includes a first guide roller (10) facing the third transport path; the second transport system includes a second guide roller (12) facing the transport path;

and at least one of the deflection rollers (19, 20) and the first and second guide rollers (10, 12) is shiftable in a direction transverse to the axis of rotation of the respective rollers and essentially parallel to the respective transport paths of the sheets in the respective transport system.

14. System according to claim 2, wherein the means (22, 23) for imparting reciprocating movement to the looping rollers is synchronized with the speed of the first, high-speed transport system, and the arrival of sheets being supplied thereby to impart to the variable speed transport belt their maximum speed when the leading edge of a sheet (8, 9) reaches the third transport path, and to then decelerate the sheet to a slower speed upon leaving the third transport path.

15. System according to claim 14, wherein the reciprocating movement imparting means comprises an eccenter-and-crank system (22, 23).

* * * * *